US009799422B2

(12) United States Patent
Mayama et al.

(10) Patent No.: US 9,799,422 B2
(45) Date of Patent: Oct. 24, 2017

(54) INSULATED ELECTRICAL WIRE AND COAXIAL CABLE

(71) Applicant: SUMITOMO ELECTRIC INDUSTRIES, LTD., Osaka-shi, Osaka (JP)

(72) Inventors: Yuhei Mayama, Osaka (JP); Shinya Nishikawa, Osaka (JP)

(73) Assignee: SUMITOMO ELECTRIC INDUSTRIES, LTD., Osaka-shi, Osaka (JP)

( * ) Notice: Subject to any disclaimer, the term of this patent is extended or adjusted under 35 U.S.C. 154(b) by 0 days.

(21) Appl. No.: 14/889,003

(22) PCT Filed: Oct. 9, 2014

(86) PCT No.: PCT/JP2014/077061
§ 371 (c)(1),
(2) Date: Nov. 4, 2015

(87) PCT Pub. No.: WO2015/111254
PCT Pub. Date: Jul. 30, 2015

(65) Prior Publication Data

US 2016/0118159 A1 Apr. 28, 2016

(30) Foreign Application Priority Data

Jan. 22, 2014 (JP) ..... 2014-009902

(51) Int. Cl.
*H01B 7/00* (2006.01)
*H01B 3/44* (2006.01)
(Continued)

(52) U.S. Cl.
CPC ..... *H01B 3/441* (2013.01); *H01B 3/443* (2013.01); *H01B 11/1895* (2013.01); *H01B 13/143* (2013.01)

(58) Field of Classification Search
CPC ..... H01B 1/02; H01B 1/023; H01B 1/026; H01B 3/28; H01B 3/30; H01B 3/32;
(Continued)

(56) References Cited

U.S. PATENT DOCUMENTS 4,166,057 A * 8/1979 Takemori ..... C08K 5/01 524/100
5,382,620 A * 1/1995 Nagase ..... C08J 5/18 524/490
2002/0109253 A1* 8/2002 Sanyal ..... H01B 13/142 264/45.9

FOREIGN PATENT DOCUMENTS

CN 102084437 A * 6/2011 ..... H01B 13/14
CN 103189442 A 7/2013
(Continued)

*Primary Examiner* — William H Mayo, III
(74) *Attorney, Agent, or Firm* — Drinker Biddle & Reath LLP

(57) ABSTRACT

An insulated electrical wire that includes a conductor and an insulating layer covering a circumferential surface of the conductor, in which the insulating layer is composed of a resin composition that contains poly(4-methyl-1-pentene) as a main component and a melt mass flow rate of the poly(4-methyl-1-pentene) measured at a temperature of 300° C. and a load of 5 kg according to the 1999 edition of JIS-K 7210 is 50 g/10 min or more and 80 g/10 min or less.

13 Claims, 3 Drawing Sheets

(51) Int. Cl.
*H01B 13/14* (2006.01)
*H01B 11/18* (2006.01)

(58) Field of Classification Search
CPC ... H01B 5/02; H01B 5/06; H01B 7/02; H01B 7/18; H01B 7/181; H01B 7/1815; H01B 7/184; H01B 7/1845; H01B 7/185; H01B 7/20; H01B 7/205; H01B 7/282; H01B 7/29; H01B 7/363; H01B 11/18; H01B 11/186; H01B 11/1834
USPC ... 174/110 R–110 PM, 120 R, 121 R, 102 R, 174/28, 29
See application file for complete search history.

(56) References Cited

FOREIGN PATENT DOCUMENTS

| | | | | | |
|---|---|---|---|---|---|
| JP | 56-73816 | A | * | 6/1981 | ..... C08L 21/00 |
| JP | S62-165807 | A | | 7/1987 | |
| JP | 02-067348 | A | * | 3/1990 | ..... C08L 23/20 |
| JP | 62-64849 | A | * | 9/1995 | ..... C08L 23/20 |
| JP | H11-323053 | A | | 11/1999 | |
| JP | 2000-311520 | A | * | 11/2000 | ..... H01B 11/06 |
| JP | 2000-311520 | A | | 11/2000 | |
| JP | 2005-307059 | A | | 11/2005 | |
| JP | WO2010/137700 | A1 | * | 12/2010 | ..... H01B 13/14 |
| JP | CN103571029 | A | * | 9/2013 | ..... C08K 13/06 |
| TW | 200915353 | A | | 4/2009 | |
| TW | 201141931 | A | | 12/2011 | |
| TW | 201317330 | A | | 5/2013 | |
| WO | WO-2010/137700 | A1 | | 12/2010 | |

* cited by examiner

INSULATED ELECTRICAL WIRE AND COAXIAL CABLE

TECHNICAL FIELD

The present invention relates to an insulated electrical wire and a coaxial cable.

BACKGROUND ART

Coaxial cables, which are constituted by insulated electrical wires that include insulator-covered conductors, external conductors covering outer peripheries of the insulated electrical wires, and jacket layers surrounding the external conductors, are used in internal wiring of electronic appliances.

Insulators used in insulated electrical wires or coaxial cables are required to exhibit low dielectric constant, good heat resistance, etc. An example of the materials for such insulators known in the art is fluorocarbon resin compositions (for example, refer to Japanese Unexamined Patent Application Publication No. 11-323053).

CITATION LIST

Patent Literature

PTL 1: Japanese Unexamined Patent Application Publication No. 11-323053

SUMMARY OF INVENTION

Technical Problem

However, fluorocarbon resin compositions have significantly low surface energy and have no adhesiveness. Accordingly, when fluorocarbon resins are used as the materials for insulators, the bonding strength between the conductors and the insulators may not always be sufficient.

Furthermore, in recent years, demand for miniaturization of electronic appliances has been particularly increasing and has required reduction in diameter of insulated electric wires and coaxial cables. However, during the process of forming thin insulators by extrusion in order to make small-diameter insulated electrical wires and coaxial cables, the extrusion pressure needs to be low in order to prevent breaking of the conductor; hence, adhesion between the insulator and the conductor tends to decrease. As a result, the conductor and the insulator tend to be spaced apart from each other and it becomes more likely for the insulator to separate from the conductor. Such an inconvenience is particularly notable when the conductor is a solid conductor.

The present invention has been made under the above-described circumstances and aims to provide an insulated electrical wire and a coaxial cable that have good adhesion between a conductor and an insulating layer and excellent properties such as low dielectric constant and high heat resistance, and are suitable for reducing the diameter.

Solution to Problem

An invention directed to resolving the above-described issues provides an insulated electrical wire that includes a conductor and an insulating layer covering a circumferential surface of the conductor, in which the insulating layer is composed of a resin composition that contains poly(4-methyl-1-pentene) as a main component and a melt mass flow rate of the poly(4-methyl-1-pentene) measured at a temperature of 300° C. and a load of 5 kg according to JIS-K7210:1999 is 50 g/10 min or more and 80 g/10 min or less.

Another invention directed to resolving the above described issues provides a coaxial cable including an insulated electrical wire that includes a conductor and an insulating layer covering a circumferential surface of the conductor, an external conductor covering a circumferential surface of the insulated electrical wire, and a jacket layer covering a circumferential surface of the external conductor, in which the insulating layer is composed of a resin composition containing poly(4-methyl-1-pentene) as a main component, and a melt mass flow rate of the poly(4-methyl-1-pentene) measured at a temperature of 300° C. and a load of 5 kg according to JIS-K7210:1999 is 50 g/10 min or more and 80 g/10 min or less, and the jacket layer contains a thermoplastic resin as a main component.

Advantageous Effects of Invention

According to the present invention, an insulated electrical wire and a coaxial cable having good adhesion between a conductor and an insulating layer and good properties such as low dielectric constant and high heat resistance, and being suitable for reducing the diameter are offered.

DESCRIPTION OF EMBODIMENTS

Figure 1:
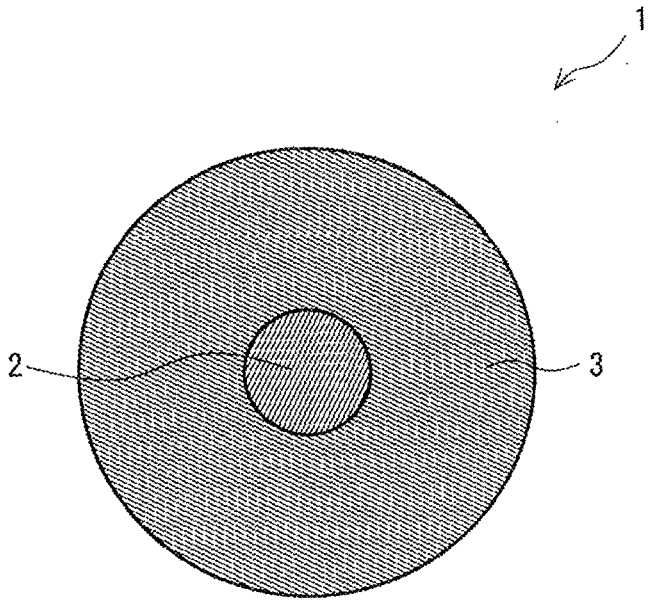
FIG. 1 is a schematic cross-sectional view of an insulated electrical wire according to a first embodiment of the present invention.

[Description of Embodiments of the Present Invention]

According to the present invention, an insulated electrical wire includes a conductor and an insulating layer covering a circumferential surface of the conductor, the insulating layer is composed of a resin composition that contains poly(4-methyl-1-pentene) as a main component, and the melt mass flow rate of the poly(4-methyl-1-pentene) measured at a temperature of 300° C. and a load of 5 kg according to JIS-K7210:1999 is 50 g/10 min or more and 80 g/10 min or less.

Since the insulating layer of the insulated electrical wire is composed of a resin composition that contains poly(4-methyl-1-pentene) as a main component, the insulating layer has low dielectric constant and high heat resistance. Since the melt mass flow rate of the poly(4-methyl-1-pentene) is within the above-described range, the flowability of the resin composition is appropriately controlled. Accordingly, in forming an insulating layer by using the resin composition, a thin insulating layer can be formed. A resin composition that contains poly(4-methyl-1-pentene) having a melt mass flow rate within the above-described range has good elongation during melting, sticks well to the conductor, and has good adhesion. Accordingly, even when a small-diameter conductor that has a small contact area for the insulating layer is used, high bonding strength is obtained between the conductor and the insulating layer and the insulated electrical wire maintains high strength. As a result, the insulated electrical wire comes to have good adhesion between the conductor and the insulating layer and excellent properties such as low dielectric constant and high heat resistance, and becomes more suitable for reducing the diameter.

The poly(4-methyl-1-pentene) content in the resin composition is preferably 60% by mass or more. When the poly(4-methyl-1-pentene) content is within this range, extrudability such as elongation during melting is further improved while maintaining the properties such as low dielectric constant and high heat resistance, and this contributes to reduction in diameter.

The melt tension of the poly(4-methyl-1-pentene) at 300° C. is preferably 5 mN or more and 8.5 mN or less. When the melt tension of the poly(4-methyl-1-pentene) is within this range, the thickness of the insulating layer can be more reliably decreased. The term "melt tension" refers to force needed to pull poly(4-methyl-1-pentene) extruded from a slit die at a tensile speed of 200 m/min at 300° C. measured with a capillary rheometer.

The melting point of the poly(4-methyl-1-pentene) measured by differential scanning calorimetry is preferably 200° C. or higher and 250° C. or lower. When the melting point of the poly(4-methyl-1-pentene) is within this range, the insulating layer exhibits high heat resistance and high processability simultaneously.

The Vicat softening temperature of the poly(4-methyl-1-pentene) measured according to JIS-K7206:1999 is preferably 130° C. or higher and 170° C. or lower. When the Vicat softening temperature of the poly(4-methyl-1-pentene) is within this range, the insulating layer exhibits high heat resistance and high processability simultaneously.

The temperature of deflection under load of the poly(4-methyl-1-pentene) measured according to JIS-K7191-2:2007 is preferably 80° C. or higher and 120° C. or lower. When the temperature of deflection under load of the poly(4-methyl-1-pentene) is within this range, the insulating layer exhibits high heat resistance and high processability simultaneously.

The tensile strain at break of the poly(4-methyl-1-pentene) measured according to JIS-K7162:1994 by using a test specimen IA is preferably 70% or more. When the tensile strain at break of the poly(4-methyl-1-pentene) is equal to or greater than the above-described lower limit, the strength of the insulating layer can be further improved.

The insulating layer preferably contains plural bubbles. When the insulating layer contains plural bubbles, plural voids taking form of fine pores are formed in the insulating layer and thus the dielectric constant of the insulating layer can be further decreased.

The insulating layer preferably has voids continuous in a longitudinal direction. When the insulating layer has voids continuous in the longitudinal direction, the dielectric constant of the insulating layer can be decreased, variation in dielectric constant of the insulating layer in the longitudinal direction can be decreased, and the transmission efficiency can be improved.

The conductor is preferably a solid conductor. Since adhesion between the insulating layer and the conductor is excellent as described above, the conductor and the insulator are rarely spaced apart from each other even when a solid conductor with a smooth surface is used as the conductor, and thus sufficient bonding strength can be obtained. Accordingly, the insulated electrical wire is preferable for use as an insulated electrical wire that includes a solid conductor.

The present invention also includes a coaxial cable that includes an insulated electrical wire including a conductor and an insulating layer covering a circumferential surface of the conductor, an external conductor covering a circumferential surface of the insulated electrical wire, and a jacket layer covering a circumferential surface of the external conductor, in which the insulating layer is composed of a resin composition that contains poly(4-methyl-1-pentene) as a main component, a melt mass flow rate of the poly(4-methyl-1-pentene) measured at a temperature of 300° C. and a load of 5 kg according to JIS-K7210:1999 is 50 g/10 min or more and 80 g/10 min or less, and the jacket layer contains a thermoplastic resin as a main component.

Since the insulating layer of the coaxial cable is composed of a resin composition containing poly(4-methyl-1-pentene) as a main component and the melt mass flow rate of the poly(4-methyl-1-pentene) is within the above-described range, the diameter can be reduced while offering excellent properties such as low dielectric constant and high heat resistance.

The thermoplastic resin is preferably a polyolefin or polyvinyl chloride. The coaxial cable can be made easily at low cost by using a polyolefin or polyvinyl chloride as a main component of the jacket layer of the coaxial cable.

Here, the "main component" refers to a component that is contained in the largest amount on a mass basis among components contained in the resin composition (for example, a component contained in an amount of 50% by mass or more).

[Detailed Description of Embodiments of Invention]

The insulated electrical wire and the coaxial cable according to the present invention will now be described with reference to the drawings.

[First Embodiment]

[Insulated Electrical Wire]

Figure 2:
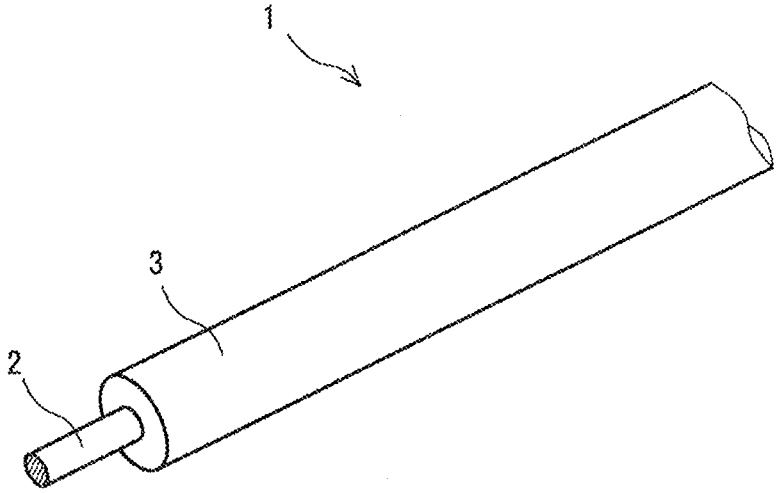
FIG. 2 is a schematic perspective view of the insulated electrical wire shown in FIG. 1.

An insulated electrical wire 1 shown in FIGS. 1 and 2 includes a conductor 2 and an insulating layer 3 covering the circumferential surface of the conductor 2.

<Conductor>

The conductor 2 is a solid conductor. The lower limit of the average diameter of the conductor 2 is preferably AWG 50 (0.025 mm) and more preferably AWG 48 (0.030 mm). The upper limit of the average diameter of the conductor 2 is preferably AWG 30 (0.254 mm), more preferably AWG 36 (0.127 mm), and yet more preferably AWG 46 (0.040 mm). When the average diameter of the conductor 2 is less than the lower limit, the strength of the conductor 2 is insufficient and the conductor may break. When the average diameter of the conductor 2 exceeds the upper limit, the diameter of the insulated electrical wire 1 may not be sufficiently reduced.

Examples of the material for the conductor 2 include soft copper, hard copper, or plated soft or hard copper. Examples of the plating include tin and nickel.

The cross-sectional shape of the conductor 2 is not particularly limited and any of various shapes such as a circular shape, a square shape, and a rectangular shape, may be employed. Among these, a circular shape is preferable since it offers excellent flexibility and plasticity. A corrosion proof layer is preferably formed on a surface of the conductor 2.

(Corrosion Proof Layer)

The corrosion proof layer suppresses a decrease in bonding strength induced by surface oxidation of the conductor 2. The corrosion proof layer preferably contains cobalt, chromium, or copper and more preferably contains cobalt or a cobalt alloy as a main component. The corrosion proof layer may be formed as a single layer or a multilayer layer. The corrosion proof layer may be formed as a plating layer. The plating layer is formed as a single metal plating layer or an alloy plating layer. The metal constituting the single metal plating layer is preferably cobalt. Examples of the alloy constituting the alloy plating layer include cobalt-based alloys such as cobalt-molybdenum, cobalt-nickel-tungsten, and cobalt-nickel-germanium.

The lower limit of the average thickness of the corrosion proof layer is preferably 0.5 nm, more preferably 1 nm, and yet more preferably 1.5 nm. The upper limit of the thickness is preferably 50 nm, more preferably 40 nm, and yet more preferably 35 nm. When the average thickness is less than the lower limit, oxidation of the conductor 2 may not be sufficiently suppressed. When the average thickness exceeds the upper limit, the anti-oxidation effect that matches the increase in thickness may not be obtained.

<Insulating Layer>

The insulating layer 3 is composed of a resin composition that contains poly(4-methyl-1-pentene) as a main component and is disposed on the circumferential surface of the conductor 2 so as to cover the conductor 2. The insulating layer 3 may be a single layer or have a multilayer structure including two or more layers. When the insulating layer 3 has a multilayer structure, different properties can be imparted to the individual layers by changing the composition of the resin composition layer by layer.

Examples of the poly(4-methyl-1-pentene) include a homopolymer of 4-methyl-1-pentene and a copolymer of 4-methyl-1-pentene and 3-methyl-1-pentene or another α-olefin. Examples of the α-olefin include propylene, butene, pentene, hexene, heptene, octene, vinyl acetate, methyl acrylate, ethyl acrylate, methyl methacrylate, and ethyl methacrylate.

The lower limit of the melt mass flow rate of the poly(4-methyl-1-pentene) measured at a temperature of 300° C. and a load of 5 kg is 50 g/10 min, preferably 55 g/10 min, and more preferably 60 g/10 min. The upper limit of the melt mass flow rate is 80 g/10 min, preferably 77 g/10 min, and more preferably 75 g/10 min.

The lower limit of the melt mass flow rate of the poly(4-methyl-1-pentene) measured at a temperature of 300° C. and a load of 2.16 kg is preferably 7 g/10 min and more preferably 8 g/10 min. The upper limit of the melt mass flow rate is preferably 13 g/10 min and more preferably 12 g/10 min.

The lower limit of the melt mass flow rate of the poly(4-methyl-1-pentene) measured at a temperature of 260° C. and a load of 5 kg is preferably 12 g/10 min and more preferably 13 g/10 min. The upper limit of the melt mass flow rate is preferably 23 g/10 min and more preferably 22 g/10 min.

When the melt mass flow rate is less than the lower limit, extrudability may be degraded, for example, the surface of the insulating layer 3 may become rough during extrusion forming of the insulating layer 3 and the covering may break. When the melt mass flow rate exceeds the upper limit, it may become difficult to adjust the thickness of the insulating layer 3.

The lower limit of the ratio of the melt mass flow rate of the poly(4-methyl-1-pentene) measured at a temperature of 300° C. and a load of 5 kg to the melt mass flow rate measured at a temperature of 300° C. and a load of 2.16 kg is preferably 6.0 and more preferably 6.4. The upper limit of the ratio is preferably 7.0 and more preferably 6.9. At a ratio less than the lower limit, the resin composition melted during extrusion forming may not sufficiently stretch. At a ratio exceeding the upper limit, the melted resin composition stretches unnecessarily and the strength of the insulating layer 3 may decrease.

The lower limit of the poly(4-methyl-1-pentene) content in the resin composition is preferably 50% by mass, more preferably 60% by mass, and yet more preferably 70% by mass. The upper limit of the content is preferably 100% by mass and more preferably 95% by mass. When the content is less than the lower limit, properties such as dielectric constant and heat resistance of the insulating layer 3 may be degraded.

The lower limit of the melt tension of the poly(4-methyl-1-pentene) at 300° C. is preferably 5 mN and more preferably 6 mN. The upper limit of the melt tension is preferably 8.5 mN and more preferably 8 mN. When the melt tension is lower than the lower limit, it may become difficult to form the insulating layer 3. At a melt tension exceeding the upper limit, extrudability of the insulating layer 3 may decrease and breaking of coverings or the like may occur.

The lower limit of the melting point of the poly(4-methyl-1-pentene) measured by differential scanning calorimetry is preferably 200° C. and more preferably 210° C. The upper limit of the melting point is preferably 250° C. and more preferably 240° C. When the melting point is less than the lower limit, heat resistance of the insulating layer 3 may be degraded. When the melting point exceeds the upper limit, the capacity of the heater used in extrusion forming of the resin composition must be increased and the processability of the insulating layer 3 may decrease.

The lower limit of the Vicat softening temperature of the poly(4-methyl-1-pentene) measured according to JIS-K7206:1999 is preferably 130° C. and more preferably 135° C. The upper limit of the Vicat softening temperature is preferably 170° C. and more preferably 160° C. At a Vicat softening temperature less than the lower limit, heat resistance of the insulating layer 3 may decrease. At a Vicat softening temperature exceeding the upper limit, the processability of the insulating layer 3 may decrease.

The lower limit of the temperature of deflection under load of the poly(4-methyl-1-pentene) measured according to JIS-K7191-2:2007 is preferably 80° C. and more preferably 85° C.

The upper limit of the temperature of deflection under load is preferably 120° C. and more preferably 110° C. When the temperature of deflection under load is less than the lower limit, heat resistance of the insulating layer 3 may decrease. When the temperature of deflection under load exceeds the upper limit, processability of the insulating layer 3 may decrease.

The lower limit of the tensile strain at break of the poly(4-methyl-1-pentene) measured according to JIS-K7162:1994 by using a test specimen IA is preferably 70% and more preferably 80%. When the tensile strain at break is lower than the lower limit, the strength of the insulating layer 3 may become insufficient.

The lower limit of the tensile rupture stress of the poly (4-methyl-1-pentene) is preferably 8 MPa and more preferably 9 MPa. When the tensile rupture stress is less than the lower limit, the strength of the insulating layer 3 may become insufficient.

The resin composition may also contain another resin not containing the poly(4-methyl-1-pentene), additives, etc.

This other resin is not particularly limited. Polyolefin, fluorocarbon resins, polyimide, polyamideimide, polyesterimide, polyester, phenoxy resins, and the like can be used.

Examples of the polyolefin include a homopolymer of ethylene or propylene, a copolymer of ethylene and α-olefin, and ethylenic ionomers. The aforementioned examples of the α-olefin that is copolymerizable with the poly(4-methyl-1-pentene) can be used as the α-olefin. Examples of the ethylenic ionomers include an ethylene-acrylic or methacrylic acid copolymer neutralized with metal ions of lithium, potassium, sodium, magnesium, zinc, or the like.

The content of this other resin in the resin composition is preferably 30% by mass or less and more preferably 20% by mass or less. When the content exceeds the upper limit, advantageous properties of the resin composition may not be fully exhibited.

Examples of the additives include a blowing agent, a flame retardant, a flame retarding aid, an antioxidant, a copper corrosion inhibitor, a pigment, a reflectance-imparting agent, a masking agent, a process stabilizer, and a plasticizer. In particular, when an unplated soft copper wire or hard copper wire is used as the conductor 2, a copper corrosion inhibitor is preferably added to prevent copper corrosion.

Examples of the blowing agent include organic blowing agents such as azodicarbonamide, and inorganic blowing agents such as sodium hydrogen carbonate. When the resin composition contains a blowing agent, bubbles are formed in the insulating layer 3.

In the case where the insulating layer 3 contains bubbles, the bubbles preferably have substantially uniform size and are preferably distributed in the insulating layer 3 at a particular density. When bubbles in the insulating layer 3 have substantially uniform size and are distributed at a particular density, the dielectric constant of the insulating layer 3 can be further decreased while maintaining the strength of the insulating layer 3. Here, "substantially uniform size" means that the volume of each bubble is within ±10% of the average volume of the bubbles.

The lower limit of the porosity of the insulating layer 3 having bubbles is preferably 20% and more preferably 30%. The upper limit of the porosity is preferably 80% and more preferably 70%. At a porosity lower than the lower limit, the dielectric constant decreasing effect that matches the increase in volume of the voids may not be obtained. At a porosity exceeding the upper limit, the strength of the insulating layer 3 may decrease. Here, the "porosity" refers to a ratio of the total area of the bubbles to the cross-sectional area of the insulating layer 3 at a cross-section taken in a desired direction of the insulating layer 3.

Various known flame retardants can be used as the flame retardant. Examples thereof include halogen-based flame retardants such as bromine-based flame retardants and chlorine-based flame retardants.

Various known flame retarding aids can be used as the flame retarding aid. An example thereof is antimony trioxide.

Various known antioxidants can be used as the antioxidant. An example thereof is a phenolic antioxidant.

Various known copper corrosion inhibitors can be used as the copper corrosion inhibitor. An example thereof is a heavy metal deactivator (ADK STAB CDA-1 produced by Adeka Corporation).

Various known pigments can be used as the pigment. An example thereof is titanium oxide.

The lower limit of the average thickness of the insulating layer 3 is preferably 0.015 mm, more preferably 0.025 mm, and yet more preferably 0.03 mm. The upper limit of the average thickness of the insulating layer 3 is preferably 0.30 mm, more preferably 0.20 mm, and most preferably 0.15 mm.

At an average thickness less than the lower limit, the strength of the insulating layer 3 may decrease. Conversely, at an average thickness exceeding the upper limit, the diameter of the insulated electrical wire 1 may not be sufficiently reduced.

<Method for Making Insulated Electrical Wire>

The insulated electrical wire 1 can be more easily and reliably made by, for example, a method that includes a conductor preparation step of preparing a conductor 2, and a covering step of covering a circumferential surface of the conductor 2 with a resin composition containing poly(4-methyl-1-pentene) as a main component.

<Conductor Preparation Step>

In the conductor preparation step, first, copper, which is a raw material of the conductor 2, is cast and rolled to obtain a rolled material.

Next, the rolled material is drawn into a wire to form a drawn wire material having a desired cross-sectional shape and a desired wire diameter (short side width). An example of the drawing method that can be employed is a method that involves inserting a rolled material coated with a lubricant through wire drawing dies of a drawing machine so that a desired cross-sectional shape and a desired wire diameter (short side width) are gradually attained. Drawing dies, roller dies, etc., can be used as the wire drawing dies. A lubricant that contains an oil component and is soluble or insoluble in water can be used as the lubricant. It is possible to process the cross-sectional shape separately after softening.

After the wire drawing, a softening process of heating the drawn wire material is performed to obtain a conductor 2. The softening process induces recrystallization of crystals in the drawn wire material and thus can improve toughness of the conductor 2. The heating temperature of the softening process is, for example, 250° C. or higher.

The softening process can be conducted in an air atmosphere but is preferably conducted in a non-oxidizing atmosphere with a low oxygen content. Performing the softening process in a non-oxidizing atmosphere can suppress oxidation of the circumferential surface of the drawn wire material during the softening process (during heating). Examples of the non-oxidizing atmosphere include a vacuum atmosphere, an inert gas atmosphere such as nitrogen or argon, and a reducing gas atmosphere such as hydrogen-containing gas or carbon dioxide gas.

The softening process may be conducted by a continuous method or a batch method. Examples of the continuous method include a furnace method in which a drawn wire material is introduced into a heating chamber such as a pipe furnace or the like and heated by heat conduction, a direct electrification method in which electricity directly passes through the drawn wire material to conduct resistive heating, and an indirect electrification method in which the drawn wire material is heated with high-frequency electromagnetic waves. Among these, the furnace method is preferable since the temperature is easy to control.

An example of the batch method is a method that involves enclosing the drawn wire material in a heating chamber such as a box-type furnace or the like and performing heating. The heating time for the batch method can be 0.5 hour to 6 hours. In the batch method, the structure can be made finer by quenching the material at a cooling rate of 50° C./sec or more after the heating.

<Covering Step>

In the covering step, an insulating layer 3 is formed on the conductor 2 obtained in the conductor preparation step described above. In particular, an insulating layer 3 is formed by extruding a resin composition containing poly(4-methyl-1-pentene), another resin, and additives. Examples of the extrusion forming method include a full extrusion method and a tubing extrusion method. The temperature of the resin composition during extrusion forming can be 260° C. or higher and 350° C. or lower.

In the case where the insulating layer 3 is constituted by two or more layers, the insulating layer 3 is preferably formed by a co-extrusion forming method.

In the case where the insulating layer 3 has fine voids having a pore shape, the blowing agent may be added to the resin composition or air or nitrogen gas may be mixed into the resin composition in performing extrusion forming during the covering step.

<Advantages>

Since the insulating layer 3 of the insulated electrical wire 1 is composed of a resin composition containing poly(4-methyl-1-pentene) as a main component, the insulating layer 3 has a low dielectric constant and high heat resistance. Moreover, since the melt mass flow rate of the poly(4-methyl-1-pentene) is within the above-described range, the flowability of the resin composition is appropriately adjusted. Due to the appropriate flowability of the resin composition, the insulating layer 3 can be formed thin. Since the resin composition has good adhesion, adhesion between the insulating layer 3 and the conductor can be increased even when the conductor has a small diameter and thus a small contact area with the insulating layer 3. As a result, the adhesion between the conductor 2 and the insulating layer 3 is improved, and the insulated electrical wire 1 is suitable for reducing diameter.

Moreover, since the conductor 2 of the insulated electrical wire 1 is a solid conductor, the distance between the conductor 2 and the insulating layer 3 is constant; hence, noise can be reduced. Accordingly, the insulated electrical wire 1 excels in various properties including dielectric constant.

[Coaxial Cable]

Figure 3:
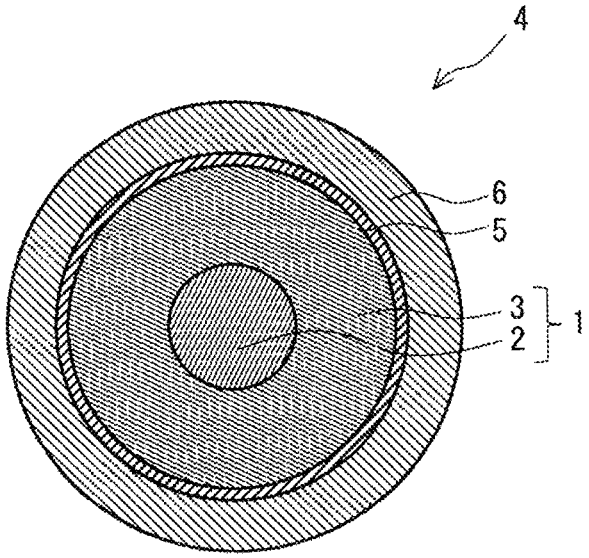
FIG. 3 is a schematic cross-sectional view of a coaxial cable according to the first embodiment of the present invention.
Figure 4:
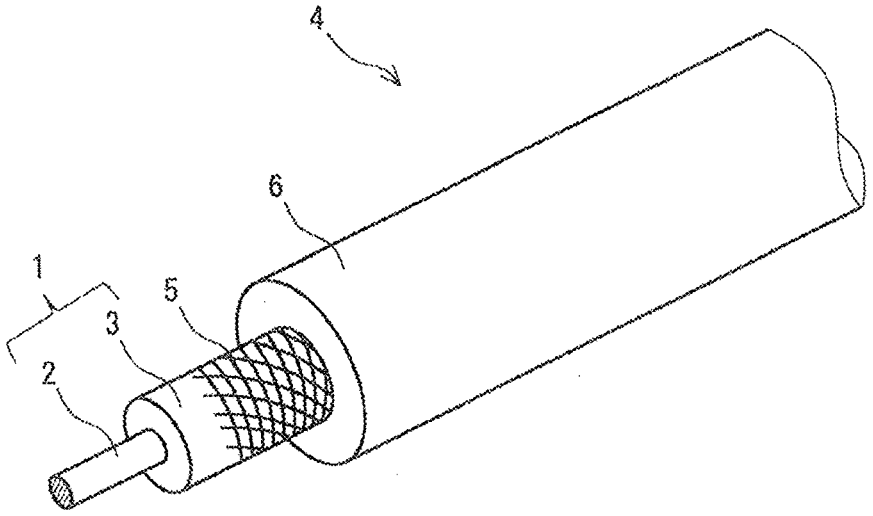
FIG. 4 is a schematic perspective view of the coaxial cable shown in FIG. 3.

Next, an embodiment of a coaxial cable according to the present invention is described with reference to FIGS. 3 and 4. In FIGS. 3 and 4, the same parts as those of the insulated electrical wire 1 shown in FIGS. 1 and 2 are represented by the same reference signs and the description thereof is omitted to avoid redundancy.

A coaxial cable 4 shown in FIGS. 3 and 4 includes the insulated electrical wire 1 constituted by a conductor 2 and an insulating layer 3 covering the circumferential surface of the conductor 2, an external conductor 5 covering the circumferential surface of the insulated electrical wire 1, and a jacket layer 6 covering the circumferential surface of the external conductor 5. That is, the coaxial cable 4 has such a structure that the conductor 2, the insulating layer 3, the external conductor 5, and the jacket layer 6 are coaxially stacked when a cross section is taken.

<External Conductor>

The external conductor 5 serves as earth and as a shield for preventing electrical interferences from other circuits. The external conductor 5 covers the outer surface of the insulating layer 3. Examples of the external conductor 5 include a braided shield, a spiral shield, a tape shield, an electrically conductive plastic shield, and a metal tube shield. Among these, a braided shield and a tape shield are preferable from the viewpoint of high-frequency shielding properties. In the case where braided shields and metal tube shields are used as the external conductor 5, the number of shields used can be appropriately determined depending on the type of shields used and the desired shielding properties. The shield may be a single shield or a multiple shield such as a double shield or a triple shield.

<Jacket Layer>

The jacket layer 6 protects the conductor 2 and the external conductor 5 and imparts functions such as insulation, flame retardancy, and weather resistance. The jacket layer 6 contains a thermoplastic resin as a main component.

Examples of the thermoplastic resin include polyvinyl chloride, low-density polyethylene, high-density polyethylene, polyethylene foam, polypropylene, polyurethane, and fluorocarbon resins. Among these, polyolefins and polyvinyl chloride are preferable from the viewpoints of cost and processability.

The insulating materials recited as examples may be used alone or in combination of two or more. An appropriate selection may be made depending on the functions to be realized by the jacket layer 6.

<Method for Making Cable>

The cable 4 is formed by covering the insulated electrical wire 1 with the external conductor 5 and the jacket layer 6.

Covering with the external conductor 5 may be performed by a known method suitable for the shielding method used. For example, a braided shield can be formed by inserting the insulated electrical wire 1 into a tubular braid and then shrinking the braid. A spiral shield can be formed by winding a metal wire such as a copper wire around the insulating layer 3. A tape shield can be formed by winding an electrically conductive tape such as an aluminum-polyester laminate tape around the insulating layer 3.

Covering with the jacket layer 6 can be performed by the same method used to cover the conductor 2 with the insulating layer 3 of the insulated electrical wire 1. Alternatively, the thermoplastic resin or the like may be applied to the circumferential surfaces of the insulated electrical wire 1 and the external conductor 5.

<Advantages>

Since the cable 4 includes the insulated electrical wire 1, the cable 4 excels in properties such as dielectric constant and is suitable for reducing diameter as with the insulated electrical wire 1 shown in FIGS. 1 and 2.

[Second Embodiment]

[Insulated Electrical Wire]

Figure 5:
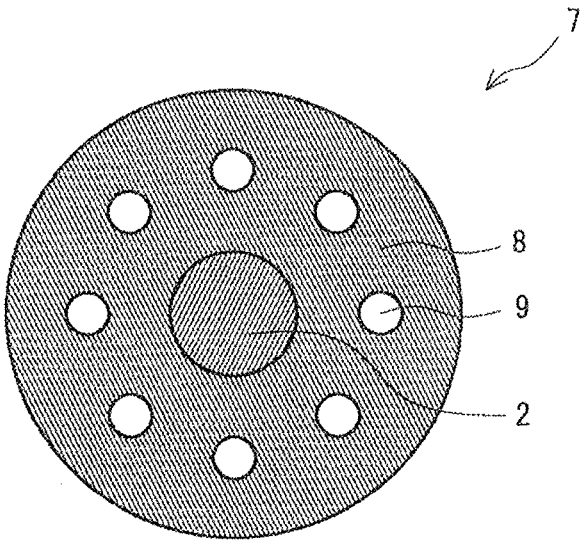
FIG. 5 is a schematic cross-sectional view of an insulated electrical wire according to a second embodiment of the present invention.

An insulated electrical wire 7 shown in FIG. 5 includes a conductor 2 and an insulating layer 8 covering the circumferential surface of the conductor 2.

The insulating layer 8 has plural voids 9 that are continuous in the longitudinal direction. In FIG. 5, the same parts as those of the insulated electrical wire 1 shown in FIGS. 1 and 2 are represented by the same reference signs and the description thereof is omitted to avoid redundancy.

The voids 9 are each a cylindrical space extending in the longitudinal direction of the insulated electrical wire 7. The cross-sectional shape of the voids 9 at a plane perpendicular to the longitudinal direction is circular. The distance between the center of the void 9 at a cross section perpendicular to the longitudinal direction and the center of the insulated electrical wire 7 at the same cross section is the same for all voids 9. The distance between the adjacent voids 9 is also the same for all voids 9.

The lower limit of the number of the voids 9 is preferably 4 and more preferably 6. The upper limit of the number of the voids 9 is preferably 12 and more preferably 10. When the number of the voids 9 is within this range, the insulating layer 8 achieves both dielectric constant and strength.

Where there are four to six voids 9, the lower limit of the ratio of the area of one void 9 to the cross-sectional area of the insulating layer 8 at a cross section perpendicular to the longitudinal direction of the insulated electrical wire 7 is preferably 6% and more preferably 7%. The upper limit of this area ratio is preferably 11% and more preferably 10%. At an area ratio less than the lower limit, the effect of decreasing dielectric constant may be insufficient. At an area ratio exceeding the upper limit, the strength of the insulating layer 8 may decrease.

Where there are seven to nine voids 9, the lower limit of the ratio of the area of one void 9 to the cross-sectional area of the insulating layer 8 at a cross section perpendicular to the longitudinal direction of the insulated electrical wire 7 is preferably 2.5% and more preferably 3%. The upper limit of the area ratio is preferably 7.3% and more preferably 6.8%. At an area ratio less than the lower limit, the effect of decreasing dielectric constant may be insufficient. At an area ratio exceeding the upper limit, the strength of the insulating layer 8 may decrease.

When there are ten to twelve voids 9, the lower limit of the ratio of the area of one void 9 to the cross-sectional area of the insulating layer 8 at a cross section perpendicular to the longitudinal direction of the insulated electrical wire 7 is preferably 2% and more preferably 2.6%. The upper limit of the area ratio is preferably 5% and more preferably 4.5%. At an area ratio less than the lower limit, the effect of decreasing dielectric constant may be insufficient. At an area ratio exceeding the upper limit, the strength of the insulating layer 8 may decrease.

The ratio r of the area of one void 9 to the cross-sectional area of the insulating layer 8 is determined from formula (1) below in which $D_1$ represents an outer diameter of the insulating layer 8, $D_2$ represents an outer diameter of the conductor 2, and $D_3$ represents an inner diameter of one void 9:

$$r=(D_3/2)^2/\{(D_1/2)^2-(D_2/2)^2\} \quad (1)$$

The lower limit of the ratio of the total area of the voids 9 to the cross-sectional area of the insulating layer 8 at a cross section perpendicular to the longitudinal direction of the insulated electrical wire 7 is preferably 15% and more preferably 20%. The upper limit of the area ratio is preferably 70% and more preferably 65%. At an area ratio less than the lower limit, the effect of decreasing the dielectric constant may be insufficient.

Conversely, at an area ratio exceeding the upper limit, the strength of the insulating layer 8 may decrease.

A know method may be employed to form the voids 9. For example, the voids 9 can be formed at the same time as covering the circumferential surface of the conductor 2 with the insulating layer 8 by using an extruder 10 shown in FIG. 6.

Figure 6:
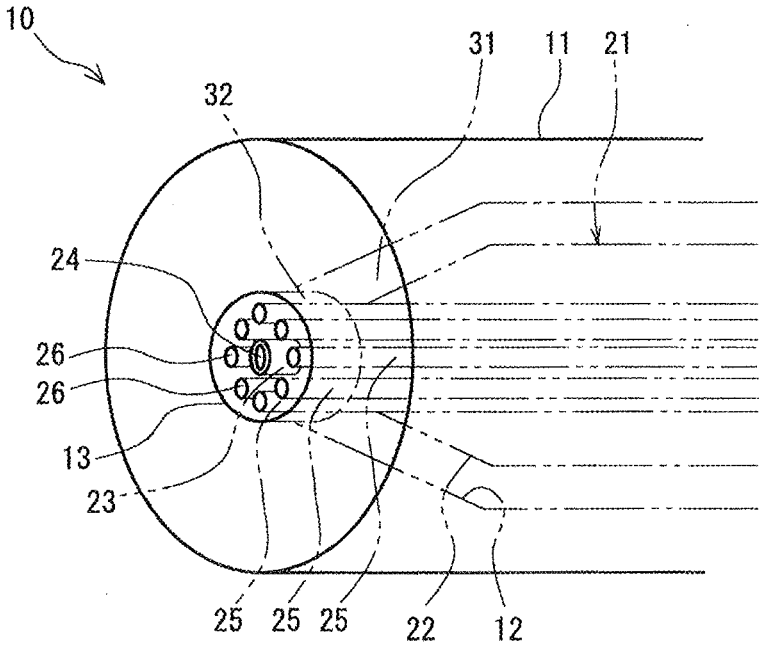
FIG. 6 is a schematic perspective view of a front end of a die of an extruder used to make the insulated electrical wire shown in FIG. 5.

The extruder 10 shown in FIG. 6 includes a die 11 and a point 21. The die 11 includes a first circular truncated cone unit 12 with an inner circumferential surface having a circular truncated cone shape, and a cylindrical extrusion opening 13 is formed at the center. The diameter of the extrusion opening 13 is constant along the lengthwise direction. The inner circumferential surface of the die 11 has a shape formed by connecting a cylinder to a circumferential surface of a circular truncated cone.

The point 21 has a second circular truncated cone unit 22 with an inner circumferential surface having a circular truncated cone shape and a cylindrical unit 23 formed at a front end of the second circular truncated cone unit 22. The center of the second circular truncated cone unit 22 and the center of the cylindrical unit 23 are coincident.

An insertion hole 24 is formed at the center of the point 21. The conductor 2 is inserted through the insertion hole 24 from behind and pulled out to the front. Here, "behind" means the side on which the second circular truncated cone unit 22 is located in the point 21 and "front" means the side on which the cylindrical unit 23 is located in the point 21.

The die 11 and the point 21 are arranged so that a particular ring-shaped gap is formed between the first circular truncated cone unit 12 and the second circular truncated cone unit 22. The gap between the first circular truncated cone unit 12 and the second circular truncated cone unit 22 serves as a first extrusion channel 31 and the gap between the extrusion opening 13 of the die 11 and the cylindrical unit 23 of the point 21 serves as a second extrusion channel 32. The first extrusion channel 31 and the second extrusion channel 32 communicate with each other. A melt of the resin composition is introduced from behind the first extrusion channel 31, sent to the second extrusion channel 32, and extruded from the extrusion opening 13.

Plural cylindrical members 25 are arranged to be equally spaced from each other on a concentric circle around the cylindrical unit 23 of the point 21. The cylindrical members 25 extend along the extrusion direction of the resin composition and are inserted into the extrusion opening 13 of the die 11 together with the cylindrical unit 23. Front ends of the cylindrical members 25 are on the same plane as the front end of the cylindrical unit 23 of the point 21 or near this plane. The cylindrical members 25 each have a through hole 26 penetrating the interior and the through hole 26 opens toward the inner space of the point 21. Accordingly, the inner space of the point 21 is not closed but is in communication with the outside of the extruder 10.

Since the cylindrical members 25 are in the first extrusion channel 31 and the second extrusion channel 32 and air is introduced through the through holes 26, the resin composition does not flow in the region where the cylindrical members 25 are present and voids 9 are formed.

<Advantages>

As with the insulated electrical wire 1 of the first embodiment, the insulated electrical wire 7 has excellent properties such as low dielectric constant and is suitable for reducing diameter. Moreover, since the voids 9 are present, the dielectric constant of the insulating layer 8 is further decreased and becomes more uniform throughout the entire insulating layer 8.

[Other Embodiments]

The embodiments disclosed herein are merely exemplary and should not be construed as limiting. The scope of the present invention is not limited to the features of the embodiments described above and is intended to include all modifications and alterations indicated by the scope of the claims and within the meaning and the scope of the equivalents of the claims.

In the embodiments, a solid conductor is used as the conductor; alternatively, a stranded conductor formed by stranding plural strands may be used. When a stranded conductor is used as the conductor, the contact area between the conductor and the insulating layer is increased and adhesion is enhanced. In the case where a stranded conductor with seven strands is used, the average diameter of the strands is preferably 0.030 mm or more and 0.302 mm or less (AWG 50 or higher and AWG 30 or lower).

When the average diameter of the strands is within the above-described range, the diameter of the insulated electrical wire can be decreased as in the case of using a solid conductor as the conductor.

Two or more of the insulated electrical wires may be assembled and integrated into a coaxial cable. In this case also, the coaxial cable can be made thinner since the diameter of the insulated electrical wires can be decreased.

The shape of the voids is not limited to ones described in the embodiments above and the cross-sectional shape at a plane perpendicular to the longitudinal direction may take any of various shapes, such as circular, rectangular, and polygonal shapes. The bubbles and the voids may coexist.

EXAMPLES

The present invention will now be described in further described through Examples. The present invention is not limited to the Examples below.

Example and Comparative Examples

Copper was cast, stretched, drawn, and softened to obtain a conductor having a circular cross section with a diameter of 0.24 mm. Next, extrusion forming was performed by draw-down using a ϕ25 mm extruder and a resin composition containing 100% by mass of poly(4-methyl-1-pentene) so that the thickness of the insulating layer was 50 μm.

The cylinder temperature during extrusion forming was 160° C., the crosshead and die temperature was set to 320° C., and a gradient was formed so that the temperature gradually increased from the cylinder toward the die so as to form an insulated electrical wire No. 1 as Example. Similarly, insulated electrical wires No. 2 and No. 3 were made as Comparative Examples so that the melt mass flow rates were the values shown in Table 1.

The melt mass flow rate (MFR) of the poly(4-methyl-1-pentene) was measured under the following conditions: "a temperature of 300° C. and a load of 5 kg", "a temperature of 300° C. and a load of 2.16 kg" and "a temperature of 260° C. and a load of 5 kg". The observed MFR values and the ratio (MFR ratio) of the value of MFR measured at "a temperature of 300° C. and a load of 5 kg" to the value of MFR measured at "a temperature of 300° C. and a load of 2.16 kg" are shown in Table 1. The melt mass flow rate in this example was measured according to JIS-K7210:1999.

The melt tension, melting point, Vicat softening point, temperature of deflection under load, tensile strain at break, tensile rupture stress, and dielectric constant of the poly(4-methyl-1-pentene) were measured under the conditions described below. The measurement results are indicated in Table 1.

In the example, the melt tension was measured with a capillary rheometer as a magnitude of force needed to pull poly(4-methyl-1-pentene) extruded from a slit die at a tensile speed of 200 m/min at 300° C.

In the example, the melting point was measured with a differential scanning calorimeter ("DSC-60" produced by Shimadzu Corporation) through differential scanning calorimetry.

In the example, the Vicat softening temperature was measured according to JIS-K7206: 1999.

In the example, the temperature of deflection under load was measured according to JIS-K7191-2:2007.

In the example, the tensile strain at break and the tensile rupture stress were measured according to JIS-K7162:1994 by using test specimens IA.

In the example, the dielectric constant was measured according to JIS-C2138:2007 with a dielectric constant measuring instrument (network analyzer produced by Hewlett Packard) at a frequency of 6 GHz.

TABLE 1

| | | No. 1 | No. 2 | No. 3 |
|---|---|---|---|---|
| MFR (300° C., 5 kg) | g/10 min | 74.8 | 95.0 | 33.3 |
| MFR (300° C., 2.16 kg) | g/10 min | 11.2 | 13.4 | 5.3 |
| MFR (260° C., 5 kg) | g/10 min | 17.2 | 23.9 | 8.0 |
| MFR ratio (300° C., 5 kg)/(300° C., 2.16 kg) | | 6.7 | 7.1 | 6.3 |
| Melt tension | mN | 7.8 | 8.8 | 11.8 |
| Melting point | ° C. | 224 | 232 | 232 |
| Vicat softening temperature | ° C. | 149 | 168 | 168 |
| Temperature of deflection under load | ° C. | 93 | 127 | 127 |
| Tensile strain at break | % | 87 | 22 | 19 |
| Tensile rupture stress | MPa | 10 | 25 | 25 |
| Dielectric constant | F/m | 2.15 | 2.11 | 2.11 |

[Evaluation]

<Tensile Strength and Tensile Strain at Break>

Conductors were pulled out from the insulated electrical wires Nos. 1 to 3. The cylindrical insulating layers (inner diameter: 0.24 mm, outer diameter: 0.34 mm, length: 10 cm) thereby obtained were analyzed according to the procedure set forth in JIS-K7161:1994 at a tensile speed of 500 mm/min so as to measure the tensile strain at break and the tensile rupture stress. The measurement results are shown in Table 2.

<Extrudability>

The surface profile of the insulated electrical wires Nos. 1 to 3 made as above was observed. Those wires which had no streaks or breaks in coverings were rated A and those wires which had streaks and/or breaks in coverings and could not be put in practical applications were rated B. The measurement results are shown in Table 2.

TABLE 2

| | | No. 1 | No. 2 | No. 3 |
|---|---|---|---|---|
| Tensile strain at break | % | 475 | 95 | 45 |
| Tensile rupture stress | MPa | 60 | 35 | 25 |
| Extrudability | | A | B | B |

The results in Table 2 show that No. 1 had excellent tensile strength, elongation at rupture, and extrudability. Thus, a small-diameter insulated electrical wire can be made based on No. 1.

INDUSTRIAL APPLICABILITY

As discussed above, the present invention offers an insulated electrical wire and a coaxial cable that have excellent adhesion between a conductor and an insulating layer and excellent properties such as low dielectric constant and high resistance, and are suitable for reducing diameter. Accordingly, the insulated electrical wire and the coaxial cable are suitable for use in wiring of electronic appliances such as mobile communication terminals for which size reduction is required.

REFERENCE SIGNS LIST

1, 7 insulated electrical wire
2 conductor
3, 8 insulating layer

4 cable
5 external conductor
6 jacket layer
9 void
10 extruder
11 die
12 first circular truncated cone unit
13 extrusion opening
21 point
22 second circular truncated cone unit
23 cylindrical unit
24 insertion hole
25 cylindrical member
26 through hole
31 first extrusion channel
32 second extrusion channel

The invention claimed is:

1. An insulated electrical wire comprising a solid conductor and an insulating layer covering a circumferential surface of the solid conductor, wherein the insulating layer is composed of a resin composition that contains poly(4-methyl-1-pentene) as a main component and a melt mass flow rate of the poly(4-methyl-1-pentene) measured at a temperature of 300° C. and a load of 5 kg according to the 1999 edition of JIS-K 7210 is 50 g/10 min or more and 80 g/10 min or less, a ratio of the melt mass flow rate of the poly(4-methyl-1-pentene) measured at a temperature of 300° C. and a load of 5 kg to the melt mass flow rate measured at a temperature of 300° C. and a load of 2.16 kg is 6.0 or more.

2. The insulated electrical wire according to claim 1, wherein a content of the poly(4-methyl-1-pentene) in the resin composition is 60% by mass or more.

3. The insulated electrical wire according to claim 1, wherein a melt tension of the poly(4-methyl-1-pentene) at 300° C. is 5 mN or more and 8.5 mN or less.

4. The insulated electrical wire according to claim 1, wherein a melting point of the poly(4-methyl-1-pentene) measured by differential scanning calorimetry is 200° C. or higher and 250° C. or lower.

5. The insulated electrical wire according to claim 1, wherein a Vicat softening temperature of the poly(4-methyl-1-pentene) measured according to the 1999 edition of JIS-K 7206 is 130° C. or higher and 170° C. or lower.

6. The insulated electrical wire according to claim 1, wherein a temperature of deflection under load of the poly(4-methyl-1-pentene) measured according to the 2007 edition of JIS-K 7191-2 is 80° C. or higher and 120° C. or lower.

7. The insulated electrical wire according to claim 1, wherein a tensile strain at break of the poly(4-methyl-1-pentene) measured according to the 1994 edition of JIS-K 7162 by using a test specimen IA is 70% or more.

8. The insulated electrical wire according to claim 1, wherein the insulating layer contains a plurality of bubbles.

9. The insulated electrical wire according to claim 1, wherein the insulating layer contains a void that is continuous in a longitudinal direction.

10. A coaxial cable comprising an insulated electrical wire that includes a solid conductor and an insulating layer covering a circumferential surface of the solid conductor, an external conductor covering a circumferential surface of the insulated electrical wire, and a jacket layer covering a circumferential surface of the external conductor, wherein the insulating layer is composed of a resin composition containing poly(4-methyl-1-pentene) as a main component, and a melt mass flow rate of the poly(4-methyl-1-pentene) measured at a temperature of 300° C. and a load of 5 kg according to the 1999 edition of JIS-K 7210 is 50 g/10 min or more and 80 g/10 min or less, and the jacket layer contains a thermoplastic resin as a main component, and a ratio of the melt mass flow rate of the poly(4-methyl-1-pentene) measured at a temperature of 300° C. and a load of 5 kg to the melt mass flow rate measured at a temperature of 300° C. and a load of 2.16 kg is 6.0 or more.

11. The coaxial cable according to claim 10, wherein the thermoplastic resin is a polyolefin or polyvinyl chloride.

12. The insulated electrical wire according to claim 1, wherein the solid conductor has a smooth surface.

13. The coaxial cable according to claim 10, wherein the solid conductor has a smooth surface.

* * * * *